US006257415B1

(12) United States Patent
Wark

(10) Patent No.: US 6,257,415 B1
(45) Date of Patent: Jul. 10, 2001

(54) MULTI-OUTLET DIFFUSER SYSTEM FOR CLASSIFIER CONES

(75) Inventor: Rickey E. Wark, The Woodlands, TX (US)

(73) Assignee: Sure Alloy Steel Corporation, Madison Heights, MI (US)

( * ) Notice: Subject to any disclaimer, the term of this patent is extended or adjusted under 35 U.S.C. 154(b) by 0 days.

(21) Appl. No.: 09/440,250

(22) Filed: Nov. 15, 1999

(51) Int. Cl.[7] ..... B04C 3/00

(52) U.S. Cl. ..... 209/722; 209/143; 209/717; 209/721

(58) Field of Search ..... 209/142, 143, 209/710, 713, 714, 717, 718, 721, 722.5

(56) References Cited

U.S. PATENT DOCUMENTS

| | | | | |
|---|---|---|---|---|
| 391,873 | | 10/1888 | Allington . | |
| 1,120,534 | | 12/1914 | Pruden . | |
| 1,315,719 | | 9/1919 | Grindle . | |
| 1,318,375 | | 10/1919 | Goff . | |
| 2,184,297 | | 12/1939 | Grindle . | |
| 2,510,240 | | 6/1950 | Mayo . | |
| 2,667,969 | * | 2/1954 | Bishop et al. | 209/34 |
| 2,868,462 | * | 1/1959 | Bogot et al. | 241/53 |
| 4,256,044 | | 3/1981 | Burton . | |
| 5,463,967 | | 11/1995 | Gielow et al. . | |
| 5,645,381 | | 7/1997 | Guidetti et al. . | |

FOREIGN PATENT DOCUMENTS

| | | | |
|---|---|---|---|
| 247350 | * | 10/1963 | (AU) . |
| 1158898 | | 12/1963 | (DE) . |
| 735373 | | 11/1932 | (FR) . |
| 822453 | | 12/1937 | (FR) . |
| 279767 | | 10/1927 | (GB) . |
| 63-259316 | * | 1/1988 | (JP) . |
| 63-259316 | | 10/1988 | (JP) . |

OTHER PUBLICATIONS

S. Schmidt, "Balancing" Pulverized Coal and Air Flows for Improved Boiler Performance, ABB C–E Services, Inc. Publication, Oct. 1998, pp. 1–10.

* cited by examiner

*Primary Examiner*—Donald P. Walsh
*Assistant Examiner*—Joseph Rodriguez
(74) *Attorney, Agent, or Firm*—Young & Basile, P.C.

(57) ABSTRACT

An apparatus for preventing uneven distributions of coal fines in the upper, outlet end of a coal mill classifier. A plurality of static diffuser elements is positioned in the upper end of the classifier, preferably within the classifier skirt if the classifier includes such structure, adjacent the inlets of multiple coal discharge pipes leading from the upper end of the classifier to a combustion chamber. In a preferred form the diffuser elements comprise vertically-arranged toothed bars mounted on the inside wall surfaces of the skirt.

6 Claims, 3 Drawing Sheets

MULTI-OUTLET DIFFUSER SYSTEM FOR CLASSIFIER CONES

FIELD OF THE INVENTION

The present invention is in the field of pressurized (fanless) coal pulverizing mills, and in particular the classifier cone structure found at the upper end of this type of mill.

BACKGROUND OF THE INVENTION

In the field of coal pulverizing mills, there are generally two types of mills characterized by the manner in which the pulverized coal is delivered from the mills to a combustion chamber: "suction" mills using exhauster fans to pull the pulverized coal fines from the mill through discharge pipes; and, "pressurized" mills which are fanless and typically entrain the pulverized coal fines in a stream of pressurized air originating at the mill itself.

Each type of mill presents its own problems with respect to the goal of supplying an even, balanced flow of coal fines through multiple pipes to multiple burners in the combustion chamber. In suction mills, for example, the exhauster fan itself tends to throw coal in an unbalanced stream, with heavier particles settling out to one side of the flow through the pipe and lighter fines on the other. In pressurized mills without exhauster fans, distribution problems tend to occur as a result of the varying lengths of discharge pipe leading from the top of the classifier to the various burners around the combustion chamber. Shorter lengths of discharge pipe generally run rich, while longer lengths of pipe tend to run lean. This rich/lean imbalance among the various burners in the combustion chamber produces the usual problems: loss on ignition (LOI) contamination of the ash byproduct; NOX formation; fireball distortion and waterwall erosion; and others known to those skilled in the art.

One common technique for trying to balance coal flow in pipes of different length is known as "clean air flow testing", in which orifice plate restricters are placed in the shorter pipes to try to balance air flow with respect to the longer (slower, lower volume) pipes in an air-only test procedure. The problem with clean air flow testing is that, having balanced air flow in a theoretical test, the introduction of coal fines produces fundamentally different results than the air-only testing would indicate, and the orifice plates worsen distribution problems among and within the pipes.

Dynamic classifiers power-rotate an array of vanes in the classifier cone to decelerate larger particles of coal and encourage lighter fines to travel up and out the classifier into the discharge pipes. It has been found, however, that the use of dynamic classifiers still results in + or −20% differences in distribution among the pipes (resulting in a 40% variance).

SUMMARY OF THE INVENTION

The present invention is believed to be the first to recognize that redistributing the coal fines immediately adjacent the discharge pipe inlets at the top of the classifier solves a majority of the downstream distribution problems. In accordance with this recognition, the invention resides in a novel, passive classifier structure to achieve uniform distribution of coal fines at the pipe inlets at the top of the classifier.

In its broadest structural form, the invention is a series of diffuser elements located in the upper end of the classifier, preferably within a cylindrical or annular "skirt" usually found surrounding the pipe inlet. The diffuser elements are preferably arranged in concentric rings within the skirt, with a first inner "ring" at or near an inner surface of the skirt, and a second outer "ring" arranged at or near an outer surface of the skirt. In a further preferred form, the diffuser elements are circumferentially located both between and aligned with the pipe inlets.

The diffuser elements comprise rows of serrations or teeth arranged vertically with their serrations or teeth projecting into the interior volume of the skirt. In a preferred, illustrated form they comprise serrated or toothed bars. It will be understood that the terms "serrations" and "toothed" are not intended to limit the invention to any particular geometric form or pattern of the teeth, as they may be pointed, rounded, truncated, squared, etc. They are, however, preferably arranged in alternating high/low patterns along the length of each diffuser element.

These and other advantages and features of the invention will become apparent upon further reading of the specification in light of the accompanying drawings.

DETAILED DESCRIPTION OF THE ILLUSTRATED EMBODIMENT

Figure 1:
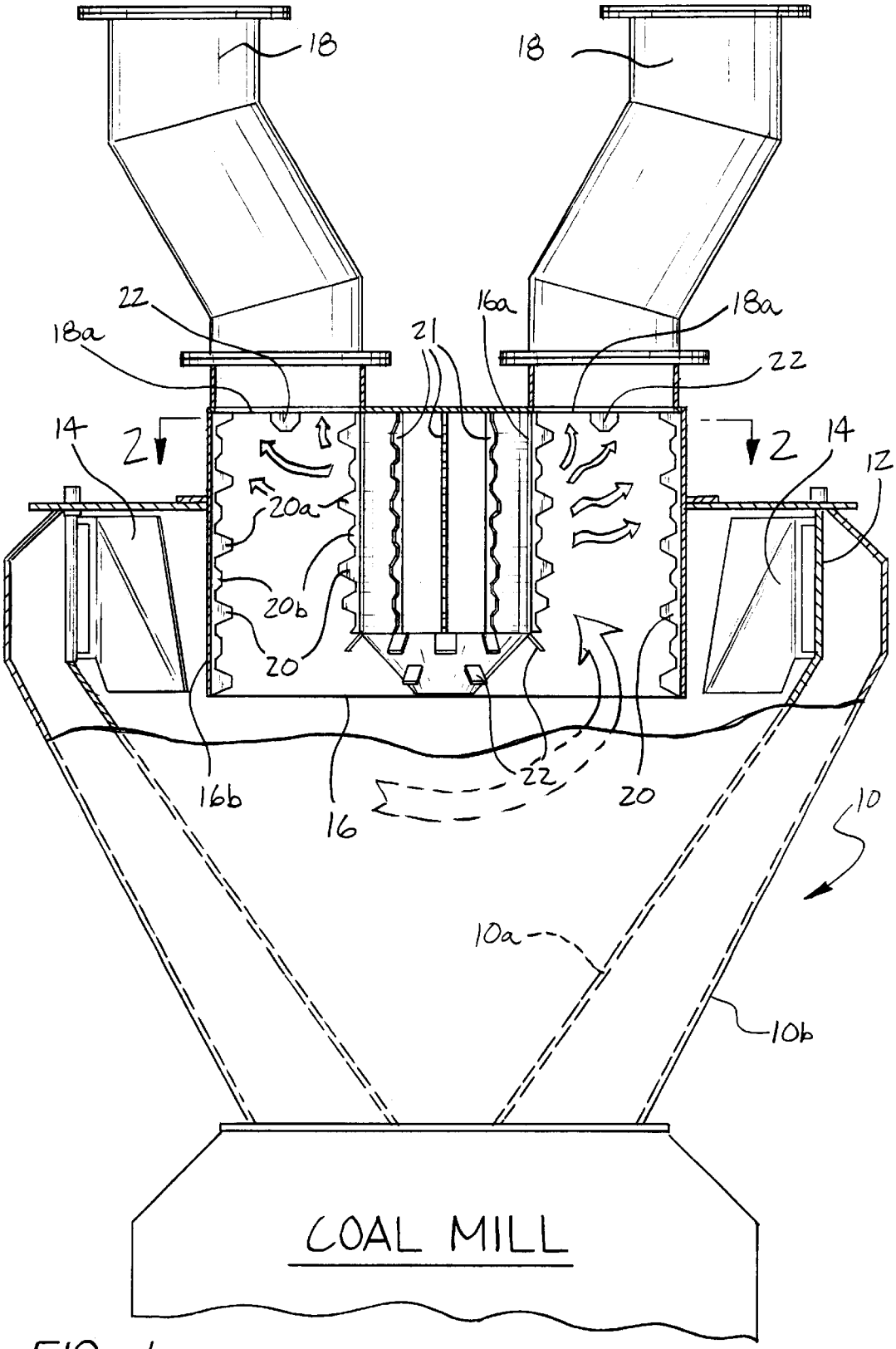
FIG. 1 is a side elevational view, in section, of a classifier equipped with the present invention in the annular "skirt" surrounding the coal pipe inlets at the top of the classifier.

Referring first to FIG. 1, a standard classifier of known, commercially available type is generally denoted by reference numeral 10, comprising an inner cone 10*a* and an outer cone 10*b*. The upper end of the cone structure is capped by a classifier cage 12 comprising a circular array of classifier vanes 14 which, in known manner, are used to direct coal fines from the pulverizer onto the inner cone surface in a manner designed to enhance the swirling, centrifugal classifying action of the cone. Heavier coal fines drop out the bottom of the cone, while lighter coal fines are swirled up and out the top of the classifier through an annular skirt 16 and into the inlets of a plurality of coal discharge pipes 18 which lead to burners in a combustion chamber. To this point all of the structure described is known.

While the illustrated embodiment is shown with a cone-type classifier, it will be understood by those skilled in the art that the invention can be used in classifiers separate from the cone structure.

The annular skirt has an inner wall 16*a* and an outer wall 16*b* defining an annular volume around which the discharge pipe inlets 18*a* are spaced. It is in this annular volume, and in particular at the pipe inlets, that distribution problems begin. Specifically, each of the pipes is typically of different length, thereby affecting the air flow through them. This imbalance in air flow is reflected in the pattern of fines swirling in the annular volume of the skirt as they approach and enter the various pipe inlets. It is typical for the volume of coal entering the pipe inlets to be significantly imbalanced as they leave the classifier. One particular problem is known as "roping", in which a tornado-like, rich concentration of coal spirals up and out the classifier toward the discharge pipe inlets, inevitably creating an imbalance as the rope favors one or more pipes over the others.

The present invention resides in a plurality of diffuser elements 20, in the illustrated embodiment in the form of a plurality of vertically-arranged, serrated or toothed bars formed from a suitably abrasion-resistant material such as steel. Diffuser elements 20 are arranged vertically on the inner and/or outer walls 16*a*, 16*b* of the skirt, secured thereto by known methods such as bolting or welding, preferably running the entire vertical length of the inner and outer walls, respectively. The teeth or serrations 20*a*, 20*b* of the diffuser elements 20 project radially (laterally) inwardly into the circumferentially-swirling coal fines in the annular volume of the skirt so as to intersect and disrupt the pattern of fines. Diffuser elements 20 are located at the inner and outer walls, since the coal tends to distribute itself unevenly with light and heavy concentrations at the inner and outer walls.

It will be understood that the use of "vertically" and "laterally" herein refer to ranges or overall orientation, and not strictly to orthogonally perfect directions. Diffuser elements that are generally more vertical than horizontal, and teeth projecting into the coal flow generally more laterally thereto than parallel, fit within the definitions used herein.

As the swirling coal fines, and in particular the uneven distribution concentrations, encounter the teeth of the diffuser elements, the uneven distributions are disrupted and the fines re-distributed in diffuse fashion within the annular volume of the skirt so that the coal flow in the various pipe inlets is evenly balanced among them.

Figure 2:
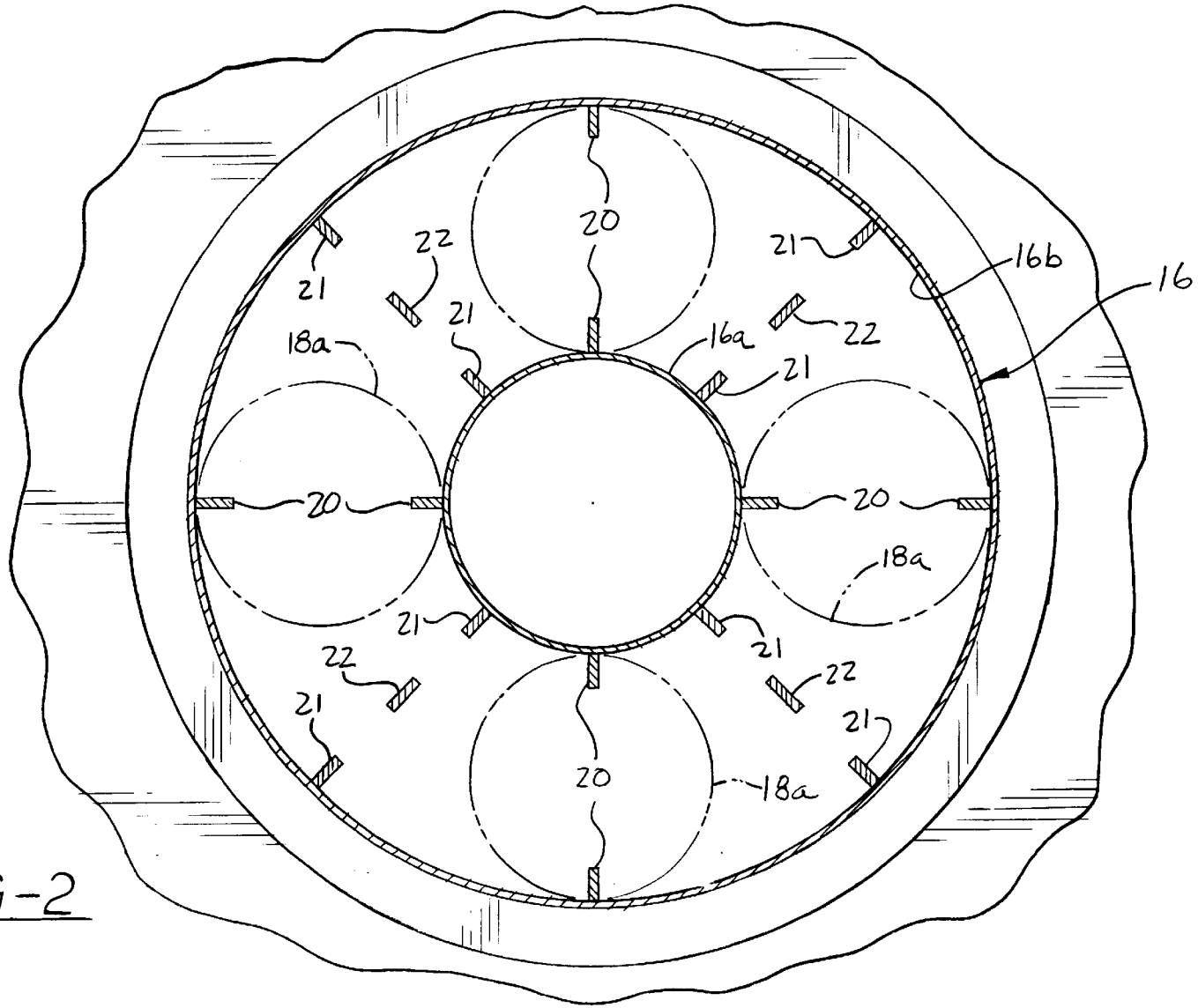
FIG. 2 is a plan view of FIG. 1.

Referring to FIG. 2, two sets of diffuser elements are illustrated: first set 20 in which inner and outer diffuser elements are aligned with pipe inlets 18*a*, and diffuser elements 21 located in the skirt between inlets 18*a*. While it is preferred to use diffuser elements both aligned with the pipe inlets and between the inlets, it may be possible in certain installations to use one or the other and still achieve good results.

It will also be apparent to those skilled in the art that it may be possible to use one or the other of the inner and outer sets of diffuser elements 20, 21, depending on the distribution problems encountered in a particular installation. It will be preferred, however, to use both the inner and outer sets on the inner and outer walls 16*a* and 16*b* of the skirt for optimum diffusion.

It is also possible to add additional diffuser elements, for example in the form of shortened diffuser elements or tabs 22 located between diffuser bars 20 and 21, at the level of the pipe inlets 18*a* and around the lower end of inner wall 16*a* of skirt 16 as best shown in FIG. 1. These and other types and placements of diffuser bars and tabs will be apparent to those skilled in the art, depending on the distribution problems encountered in the particular classifier, now that I have disclosed the preferred embodiment of my invention.

Figure 3:
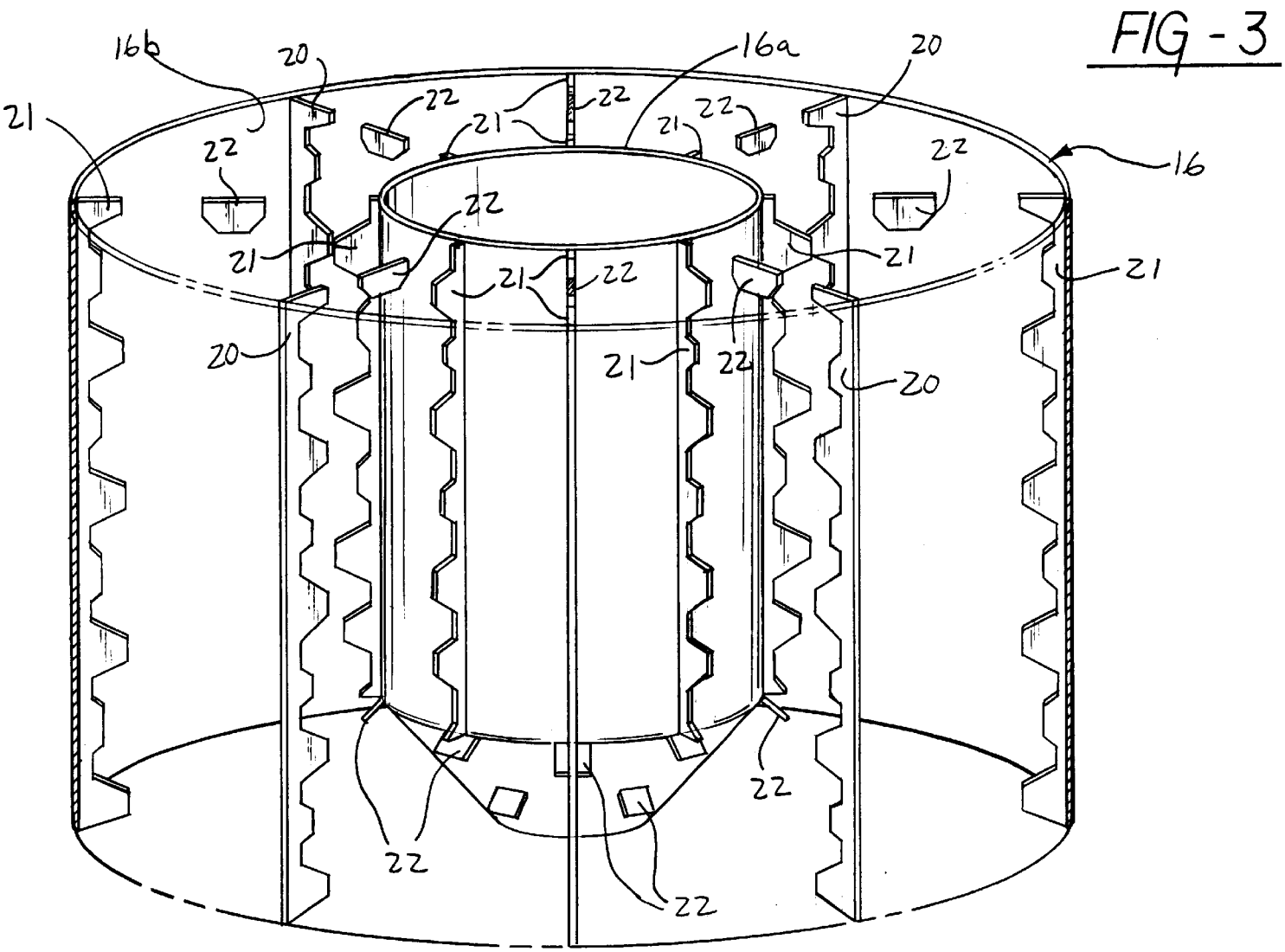
FIG. 3 is a perspective view of the invention-equipped skirt at the upper end of the classifier.

FIG. 3 is a schematic, perspective representation of the classifier of FIGS. 1 and 2 equipped with diffuser bars according to the invention. It can be seen how the diffuser bars disrupt and evenly distribute the coal flow concentrations which tend to occur in the swirling fines inside the skirt.

The length of the diffuser elements 20, their placement inside the skirt, and the shape and size of their teeth or serrations are all subject to variance, depending on the desired diffusion effect for the coal distribution problems encountered in a particular classifier installation.

Generally, however, the bars will be vertically arranged on the wall surfaces of the skirt. A high/low alternating sequence of teeth or serrations is preferred, although the shape (rounded, pointed, truncated, squared) can vary, with the illustrated pattern currently being preferred. The diffuser elements preferably extend from as close to the pipe inlet as practicable as far down into the classifier as practicable, with the illustrated full-length diffuser elements being a preferred arrangement for diffusion along the entire interior wall surface of the skirt.

It will be understood by those skilled in the art that while the diffuser elements have been illustrated as serrated or toothed bars secured to the interior of the classifier by known methods such as bolting or welding the bars to the walls of the classifier, the diffuser elements can be formed integrally in the classifier during the manufacture of the classifier itself, for example by forming vertical rows of the teeth or serrations 20*a*, 20*b* in the walls of the classifier. It is also possible to add the teeth or serrations 20*a*, 20*b* to the classifier walls singly rather than in pre-formed bars containing multiple teeth, although the pre-formed bar arrangement illustrated is preferred.

It will also be apparent to those skilled in the art that the position of the diffuser elements in the skirt will depend on the type of skirt employed in a particular classifier. Whereas the annular skirt 16 illustrated in FIGS. 1 and 3 is common, other types of skirt will be known to those skilled in the art.

These and other modifications and adjustments for particular applications can be made without departing from the scope of my invention now that I have disclosed my preferred embodiment. Accordingly, I claim:

What is claimed is:

1. For use in a classifier of the type having a plurality of coal discharge pipe inlets at its upper end, the upper end of the classifier including a classifier skirt defining a swirling annular volume of classified coal fines suitable for discharge through the pipe inlets for combustion, an apparatus for providing uniformly distributed coal fines to the inlets, comprising:

a plurality of diffuser elements located in the swirling annular volume of the skirt placed in the upper end of the classifier where coal fines exit the classifier into the inlets to disrupt concentrations of coal flow into a diffuse, evenly distributed pattern relative to the inlets, the diffuser elements comprising elongated rows of teeth mounted vertically relative to the classifier with the teeth extending radially partway into the swirling annular volume.

2. The apparatus of claim 3, wherein the skirt is an annular skirt having inner and outer interior wall surfaces, and the diffuser elements are mounted on the inner and outer interior wall surfaces.

3. The apparatus of claim 1, wherein the diffuser elements arc aligned with the pipe inlets.

4. The apparatus of claim 1, wherein the diffuser elements are aligned between the pipe inlets.

5. The apparatus of claim 1, wherein a first set of the diffuser elements is aligned with the pipe inlets, and a second set of the diffuser elements is aligned between the pipe inlets.

6. The apparatus of claim 2, wherein the diffuser elements extend radially into the annular swirling volume of the skirt from the inner and outer interior wall surfaces.

* * * * *

UNITED STATES PATENT AND TRADEMARK OFFICE

CERTIFICATE OF CORRECTION

PATENT NO. : 6,257,415 B1
DATED : July 10, 2001
INVENTOR(S) : Wark

It is certified that error appears in the above-identified patent and that said Letters Patent is hereby corrected as shown below:

Column 4,
Lines 41-42, delete the phrase "placed in the upper end of the classifier where coal fines exit the classifier into the inlets";
Lines 45-46, replace "rows of teeth" with -- toothed bars --;
Line 46, after "mounted", insert -- on an interior wall of the classifier skirt --;
Line 47, replace "the teeth" with -- toothed portions of the bars --;
Line 49, replace "3" with -- 1 --;
Lines 50, 52, and 63, replace "wall surfaces" with -- walls --;
Line 54, replace "arc" with -- are --.

Signed and Sealed this

First Day of April, 2003

JAMES E. ROGAN
*Director of the United States Patent and Trademark Office*